US006361236B1

(12) United States Patent
Podosek

(10) Patent No.: US 6,361,236 B1
(45) Date of Patent: Mar. 26, 2002

(54) PAPER STORAGE ITEM AND METHOD OF MAKING SAME

(75) Inventor: Edward Podosek, Wilbraham, MA (US)

(73) Assignee: Avery Dennison Corporation, Pasadena, CA (US)

( * ) Notice: Subject to any disclaimer, the term of this patent is extended or adjusted under 35 U.S.C. 154(b) by 222 days.

(21) Appl. No.: 08/907,398

(22) Filed: Aug. 7, 1997

(51) Int. Cl.[7] ..... B42F 3/00

(52) U.S. Cl. ..... 402/70; 402/70; 402/73; 281/29; 281/37; 281/15.1

(58) Field of Search ..... 281/28, 29, 30, 281/34–37; 402/70, 73–78, 502; 412/1

(56) References Cited

U.S. PATENT DOCUMENTS

| | | | | |
|---|---|---|---|---|
| 2,486,330 A | | 10/1949 | Schade | |
| 3,308,003 A | | 3/1967 | Deans | |
| 3,454,694 A | | 7/1969 | Delaire et al. | |
| 3,572,957 A | | 3/1971 | Strassberg | |
| 4,056,326 A | | 11/1977 | Crawford | |
| 4,534,819 A | | 8/1985 | Payet et al. | |
| 4,560,427 A | | 12/1985 | Flood | |
| 4,583,877 A | | 4/1986 | Wilson | |
| 4,610,750 A | | 9/1986 | Mango | |
| 4,693,771 A | | 9/1987 | Payet et al. | |
| 4,856,817 A | | 8/1989 | Moor | |
| 5,020,828 A | | 6/1991 | Moor | |
| 5,127,786 A | | 7/1992 | Cross | |
| 5,219,437 A | | 6/1993 | Moor et al. | |
| 5,441,357 A | | 8/1995 | Wilson | |
| 5,449,428 A | * | 9/1995 | Desmarais et al. | 156/274.4 |
| 5,476,570 A | | 12/1995 | Widmann | |
| 5,607,246 A | | 3/1997 | Podosek | |
| 5,620,207 A | | 4/1997 | Podosek et al. | |
| 5,660,514 A | * | 8/1997 | Wilson | 412/1 |
| RE35,991 E | * | 12/1998 | Desmarais et al. | 156/274.4 |

FOREIGN PATENT DOCUMENTS

| | | |
|---|---|---|
| DE | 2937171 | 4/1981 |
| EP | 310525 | 4/1989 |
| GB | 2199536 | 7/1988 |
| RU | 571-296 | 9/1977 |
| WO | PCTAT9000068 | 1/1992 |

* cited by examiner

*Primary Examiner*—Willmon Fridie, Jr.
(74) *Attorney, Agent, or Firm*—Kriegsman & Kriegsman

(57) ABSTRACT

A ring binder and method of making the same. According to a preferred embodiment, the ring binder comprises a front cover stiffening member, a spine stiffening member and a rear cover stiffening member, all of which are appropriately positioned between a matching pair of woven sheets. The woven sheets are made of a synthetic fiber or thread that is ultrasonically weldable. Examples of materials that may be suitable for use as the synthetic fiber or thread include polyvinyl chloride, polypropylene, polyethylene, nylon, orlon, rayon and combinations thereof. The woven sheets are ultrasonically welded together around their respective peripheries and on opposite sides of the spine stiffening member to define, together with the three stiffening members, a front cover, a spine and a rear cover. The binder further includes a paper-retaining ring mechanism, which is secured to the spine or to one of the front and rear covers.

13 Claims, 6 Drawing Sheets

PAPER STORAGE ITEM AND METHOD OF MAKING SAME

BACKGROUND OF THE INVENTION

The present invention relates generally to loose leaf binders, portfolios and similar paper storage items and relates more particularly to a novel paper storage item and method of making the same.

Loose leaf binders and, in particular, ring binders are commonly used in the home, office and/or school to store one or more sheets of paper in an organized fashion. Conventionally, ring binders most frequently exist in either of two different varieties. One such variety is commonly referred to in the art as a "case-made binder" and is typically made by the following technique: First, an oversized sheet of material, which is typically fabric woven from a natural fiber, is affixed with an adhesive to the outside surface of one or more stiffening members arranged to define a front cover panel, a spine panel and a rear cover panel. The exposed marginal edges of the oversized sheet of material are then turned over onto the inside surface of the one or more stiffening members and are affixed thereto with an adhesive. Next, a slightly undersized sheet of material, which is typically made of the same type of material as the aforementioned oversized sheet, is laid over and adhered both to the inside surface of the one or more stiffening members and to the turned-over edges of the oversized sheet. A paper-retaining, ring mechanism is then attached to either the spine or one of the covers of the thus-fabricated case.

A representative example of a case-made ring binder is disclosed in U.S. Pat. No. 5,441,357, inventor Wilson, issued Aug. 15, 1995, which is incorporated herein by reference.

The other common variety of ring binder is frequently referred to in the art as a "plastic binder" and is typically made as follows: First, a pair of matching sheets of thermoplastic material, typically polyvinyl chloride (PVC), are positioned on opposite sides of one or more stiffening members arranged to define a front cover panel, a spine panel and a rear cover panel. Next, the sheets are welded together, typically by radio frequency (rf) welding, around their respective peripheries. In addition, the sheets are also typically rf welded together along a pair of hinge lines on opposite sides of the spine panel. Finally, a paper-retaining, ring mechanism is attached to either the spine or one of the covers.

Representative examples of plastic binders are disclosed in the following patents, all of which are incorporated herein by reference: U.S. Pat. No. 3,572,957, inventor Strassberg, issued Mar. 30, 1971; U.S. Pat. No. 2,486,330, inventor Schade, issued Oct. 25, 1949; U.S. Pat. No. 4,583,877, inventor Wilson, issued Apr. 22, 1986; U.S. Pat. No. 4,586,817, inventor Moor, issued Aug. 15, 1989; U.S. Pat. No. 5,020,828, inventor Moor, issued Jun. 4, 1991; U.S. Pat. No. 5,607,246, inventor Podosek, issued Mar. 4, 1997; and U.S. Pat. No. 5,620,207, inventors Podosek et al., issued Apr. 15, 1997.

In general, case-made binders are more durable and are more aesthetically pleasing than are plastic binders. This is due, in large part, to the use of fabric for the inner and outer coverings in case-made binders, said fabric coverings tending to have a pleasant textured appearance and tending to wear better than do extruded sheets of thermoplastic material. On the other hand, plastic binders are, in general, less expensive to manufacture than are case-made binders. This is due, in part, to the relative costs of materials used to make plastic binders and case-made binders and is due, in part, to the fact that the method for making plastic binders is less time-consuming and is more readily adaptable to automation than is the method for making case-made binders.

Historically, however, plastic binders have suffered from the additional limitation that only certain types of thermoplastic sheet materials have been used commercially as the inner and outer covers for the binder. This has been because rf welding has traditionally been the most common technique used commercially to weld together the pair of thermoplastic sheets along the hinge lines and around the peripheries and because only a limited number of thermoplastic materials, such as vinyl (i.e., PVC), are amenable to being welded together by rf welding.

In U.S. Pat. No. 5,219,437, inventors Moor et al., which issued Jun. 15, 1993 and which is incorporated herein by reference, there is disclosed a fabric covered book cover comprising an inside surface adjacent the contents of the book cover and an outside surface opposite the inside surface which comes into contact with the hand when the book cover is carried. In a more preferred embodiment, the fabric material is woven nylon or another synthetic material. The book cover includes two leafboards which are rectangular and formed by first and second stiffening members, each stiffening member when incorporated in the book cover having three outside edges which form the periphery of the cover and one internal edge. The fabric encases the stiffening members which are spaced apart on the fabric. A peripheral seam is located along and immediately outside the outside edges of the stiffening members. A pair of parallel and spaced seams running along and immediately adjacent the internal edges of the stiffening members maintain the position of both stiffening members within the fabric. The spine is formed by a portion of fabric which connects the front and back leafboards. The spine includes a plurality of parallel longitudinal seams which enable the spine to curl flexibly such that it is easily cupped in the palm of the hand. In a more preferred embodiment, the spine has a padding member encased therein and the plurality of seams maintain a constant amount of the padding material between each parallel stitched seam and thus prevent the padding member from accumulating unevenly in the spine. At the periphery of the book cover, a thin reinforcing fabric border may overlap the periphery of the inside and outside surfaces and is stitched into the peripheral seam.

Other patents and publications that may be of interest include U.S. Pat. No. 4,056,326, inventor Crawford, which issued Nov. 1, 1997; U.S. Pat. No. 5,127,786, inventor Cross, which issued Jul. 7, 1992; U.S. Pat. No. 3,454,694, inventors Delaire et al., which issued Jul. 8, 1969; and published PCT Application No. PCT/AT90/00068, published Jan. 23, 1992, all of which are herein incorporated by reference.

SUMMARY OF THE INVENTION

It is an object of the present invention to provide a novel paper storage item and method of making the same.

According to a first preferred embodiment, the paper storage item of the present invention is in the form of a ring binder. Said ring binder of said first preferred embodiment comprises three stiffening members appropriately arranged as a front cover stiffening panel, a spine stiffening panel and a rear cover stiffening panel. In addition, said ring binder comprises inner and outer woven synthetic sheets, said inner and outer woven synthetic sheets being positioned on opposite sides of said three stiffening members and being welded together, preferably ultrasonically, around their respective peripheries and on opposite sides of the spine stiffening member. Said ring binder of said first preferred embodiment further comprises a ring mechanism secured to one of the stiffening members through the inner woven synthetic sheet.

As can readily be appreciated, the above-described ring binder of the present invention possesses a textured appearance and other aesthetic properties along the lines of case-made ring binders and, at the same time, is capable of being manufactured with an ease comparable to that for plastic binders (and being similarly adaptable to automation). Moreover, because ultrasonic welding, as opposed to rf welding, is preferably used to weld together the inner and outer woven synthetic sheets, said sheets need not be made of the limited number of rf weldable materials, such as vinyl, but rather, can be made from a wide range of synthetic (i.e., plastic) materials, including, but not limited to, vinyl, polypropylene, polyethylene, nylon, orlon, rayon and combinations thereof.

According to a second preferred embodiment, the paper storage item of the present invention is also in the form of a ring binder. Said ring binder of said second preferred embodiment comprises three stiffening members appropriately arranged as a front cover stiffening panel, a spine stiffening panel and a rear cover stiffening panel. In addition, said ring binder also comprises inner and outer synthetic sheets, said inner synthetic sheet being a continuous film, said outer synthetic sheet being a woven sheet, said inner and outer synthetic sheets being positioned on opposite sides of said three stiffening members and being welded together, preferably ultrasonically, around their respective peripheries and on opposite sides of the spine stiffening member. Said ring binder of said second preferred embodiment further comprises a strip of extruded synthetic material, said strip being welded, preferably ultrasonically, to said inner synthetic sheet so as to form a pocket or sleeve therewith. Depending on the size of said strip, said pocket or sleeve may be used to hold papers, writing instruments or the like. Finally, said ring binder also comprises a ring mechanism secured to one of the stiffening members through the inner woven synthetic sheet.

It should be appreciated that the principles of the present invention can be applied to other types of loose leaf binders, besides ring binders, and to paper storage items other than loose leaf binders, such as portfolios, pocket folders, book covers, pad holders, mailbags and the like. It should also be appreciated that various features of the two preferred embodiments described above may be combined in additional embodiments.

Additional objects, as well as features, advantages and aspects of the present invention, will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate preferred embodiments of the invention and, together with the description, serve to explain the principles of the invention. In the drawings wherein like reference numerals represent like parts.

DETAILED DESCRIPTION OF PREFERRED EMBODIMENTS

Figure 1:
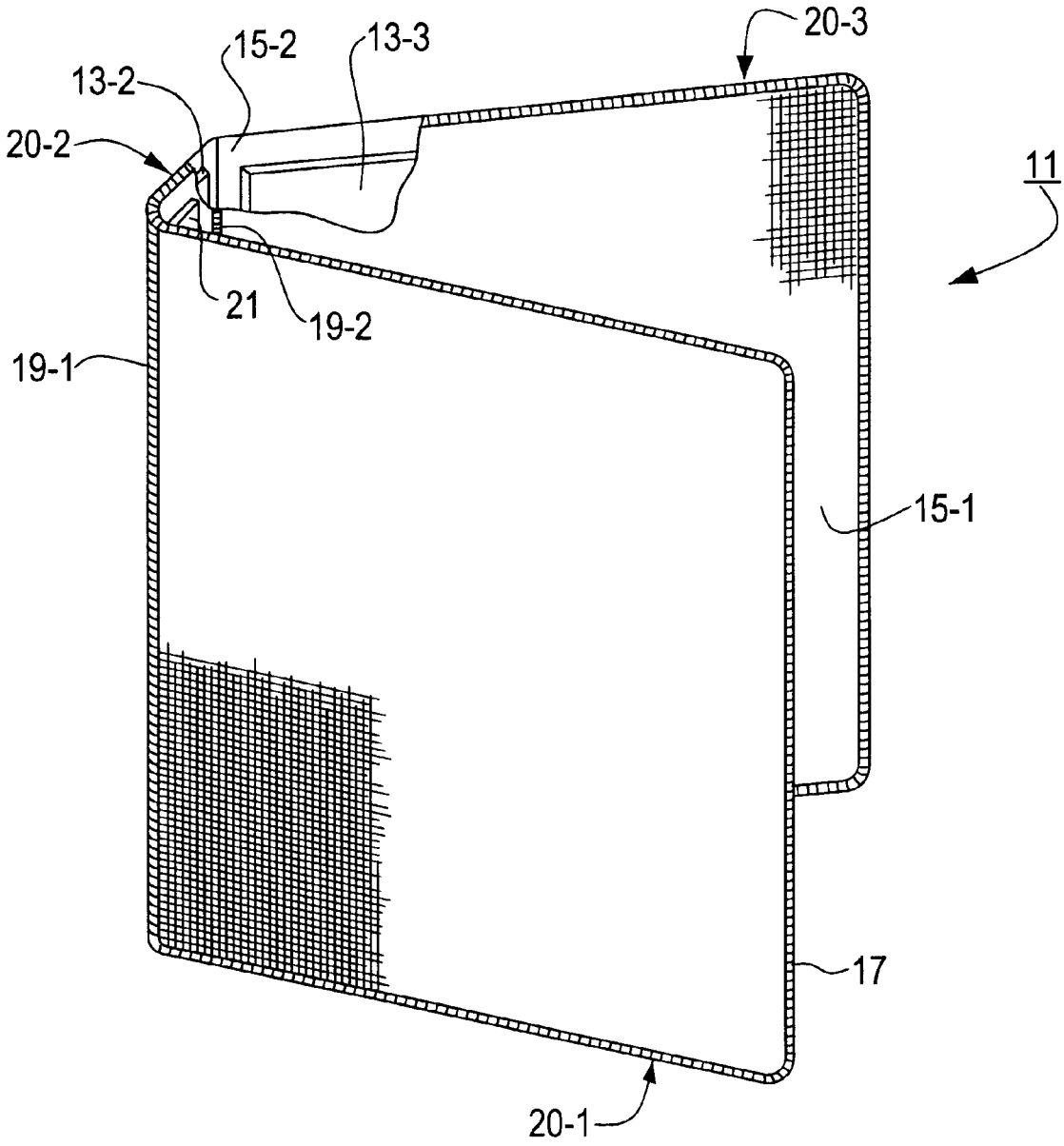
FIG. 1 is a perspective view, broken away in part, of a first embodiment of a paper storage item constructed according to the teachings of the present invention, said paper storage item being in the form of a ring binder shown in a closed configuration.
Figure 2:
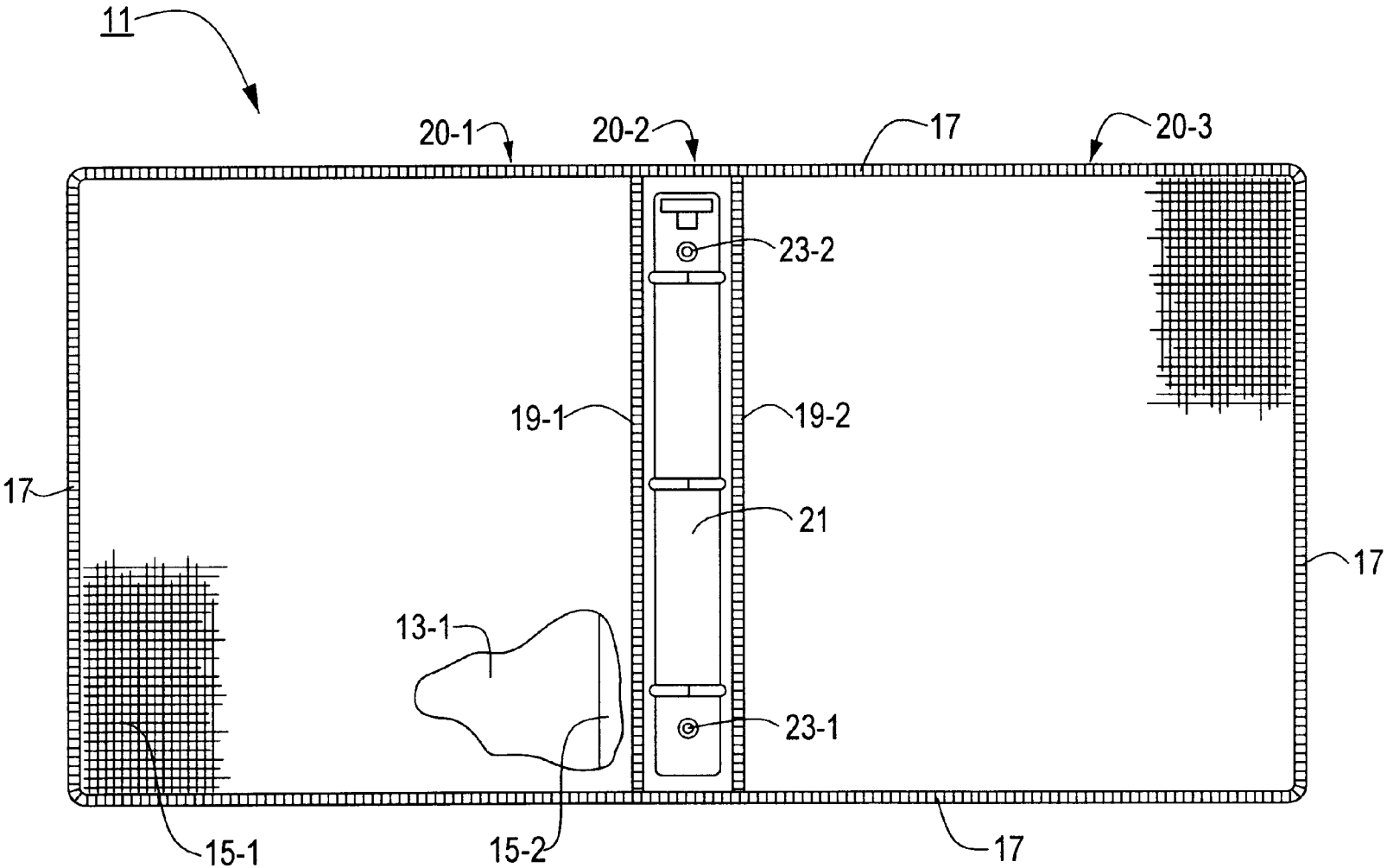
FIG. 2 is a top view, broken away in part, of the paper storage item of FIG. 1, said paper storage item being shown in an open configuration.
Figure 3:
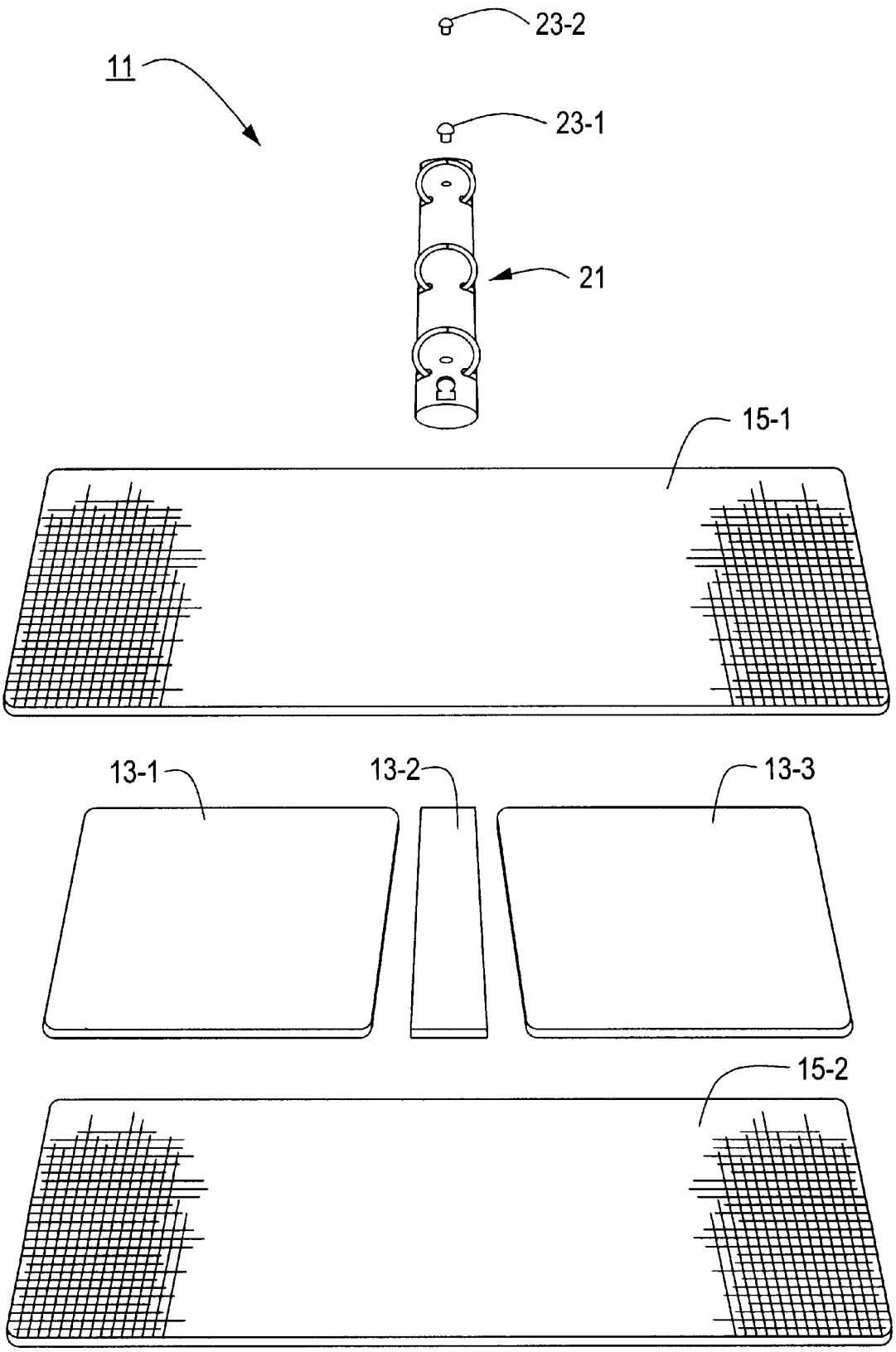
FIG. 3 is an exploded perspective view of the components of the paper storage item of FIG. 1, prior to assembly.

Referring to FIGS. 1 through 3, there are shown various views of a first embodiment of a paper storage item constructed according to the teachings of the present invention, the paper storage item being in the form of a ring binder represented generally by reference numeral 11. Perspective and top views of binder 11, fully assembled, are shown in FIGS. 1 and 2. An exploded perspective view of binder 11, prior to assembly, is shown in FIG. 3.

As seen best in FIG. 3, ring binder 11 comprises a plurality of stiffening members 13-1 through 13-3, which may be made of cardboard, chipboard, fiberboard or another similarly suitable material. As will hereinafter be seen, stiffening members 13-1 through 13-3 are appropriately arranged to help form the front cover, spine and rear cover, respectively, of binder 11.

Ring binder 11 also comprises a matching pair of woven sheets 15-1 and 15-2. Sheets 15-1 and 15-2, which are disposed on opposite sides of stiffening members 13-1 through 13-3 so as to form respective inner and outer cover sheets thereto, are woven from a synthetic, ultrasonically-weldable fiber or thread. Materials that may be used to form said synthetic, ultrasonically-weldable fiber or thread include, but are not limited to, a wide range of plastics, such as vinyl, polypropylene, polyethylene, nylon, orlon, rayon and combinations thereof. As seen best in FIGS. 1 and 2, sheets 15-1 and 15-2 are ultrasonically welded together around their respective peripheries to form a peripheral seam 17. (For simplicity and clarity, the individual fibers of sheets 15-1 and 15-2 are not shown throughout sheets 15-1 and 15-2.) In addition, sheets 15-1 and 15-2 are ultrasonically welded together along a pair of hinge lines 19-1 and 19-2 located on opposite sides of stiffening member 13-2, hinge lines 19-1 and 19-2 helping to demarcate the front cover 20-1, spine 20-2 and rear cover 20-3 (see FIG. 1) of binder 11 and to keep in place members 13-1 through 13-3.

Ring binder 11 further comprises a conventional paper-retaining ring mechanism 21. In the embodiment shown, mechanism 21 is secured to the inside of spine 20-2 by a pair of rivets 23-1 and 23-2; however, it is to be understood that, instead of being secured to the inside of spine 20-2, mechanism 21 could alternatively be secured to the inside of front cover 20-1 or to the inside of rear cover 20-3.

To fabricate binder 11 according to one method, one appropriately positions stiffening members 13-1 through 13-3 between sheets 15-1 and 15-2. Next, one ultrasonically welds together sheets 15-1 and 15-2 around their respective peripheries and on opposite sides of member 13-2. Finally, one secures ring mechanism 21 to spine 20-2 with rivets 23-1 and 23-2. As can readily be appreciated, some or all of the steps in the fabrication of binder 11 can be automated.

It is to be understood that sheets 15-1 and 15-2 may be rf welded together or thermally welded together, instead of being ultrasonically welded together, if sheets 15-1 and 15-2 are fabricated from a material that permits such welding techniques.

Figure 4:
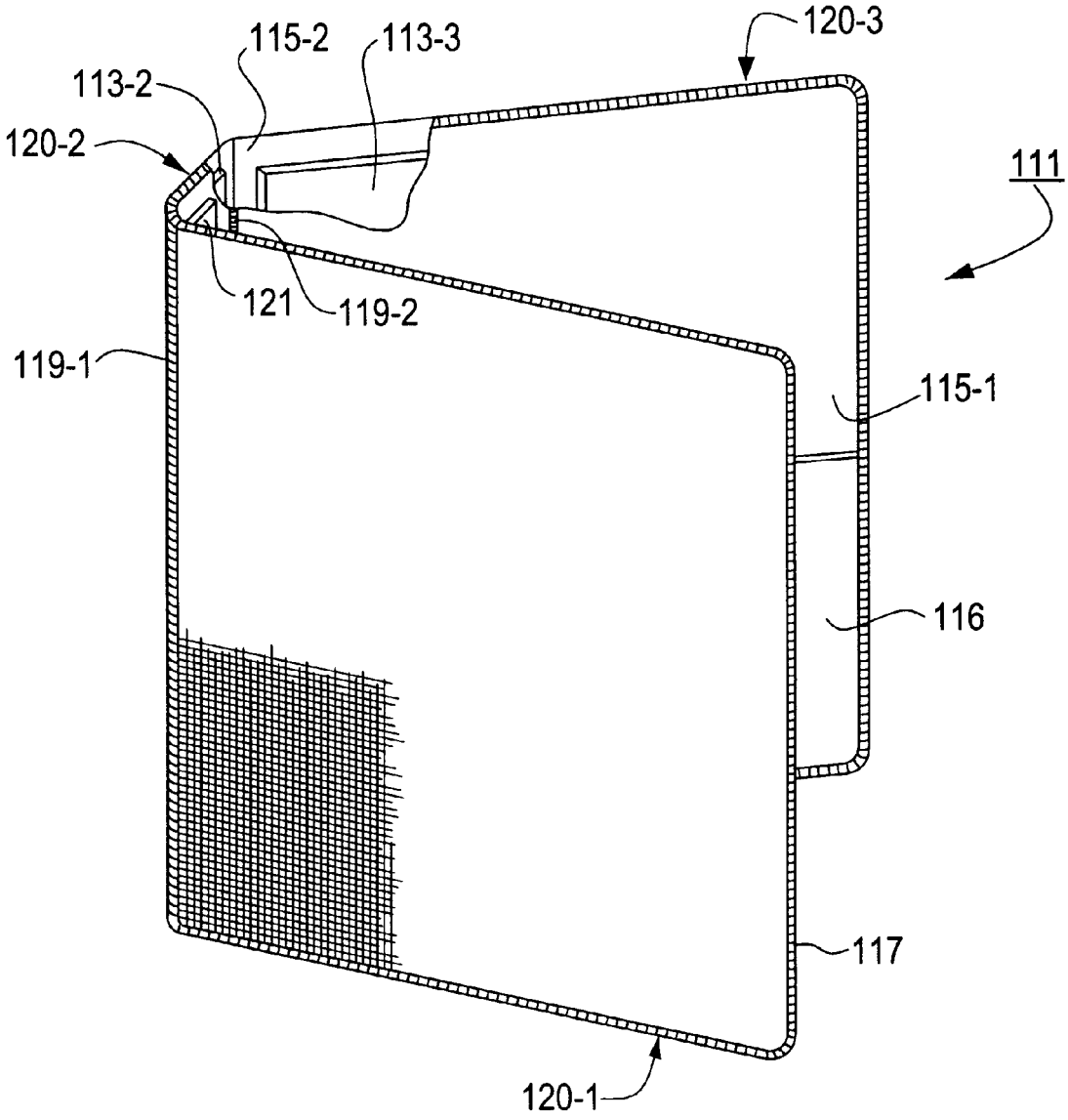
FIG. 4 is a perspective view, broken away in part, of a second embodiment of a paper storage item constructed according to the teachings of the present invention, said paper storage item being in the form of a ring binder shown in a closed configuration.
Figure 5:
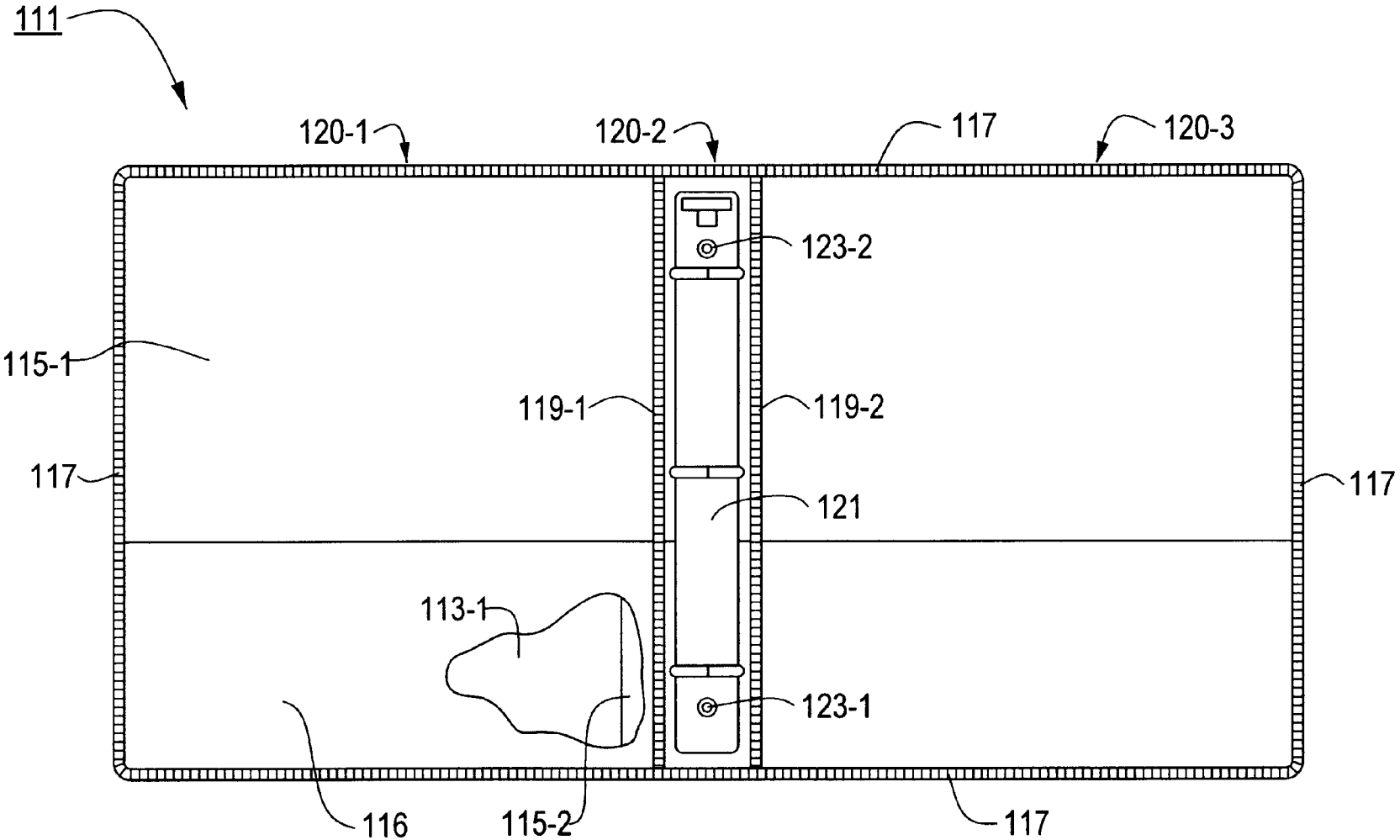
FIG. 5 is a top view, broken away in part, of the paper storage item of FIG. 4, said paper storage item being shown in an open configuration.
Figure 6:
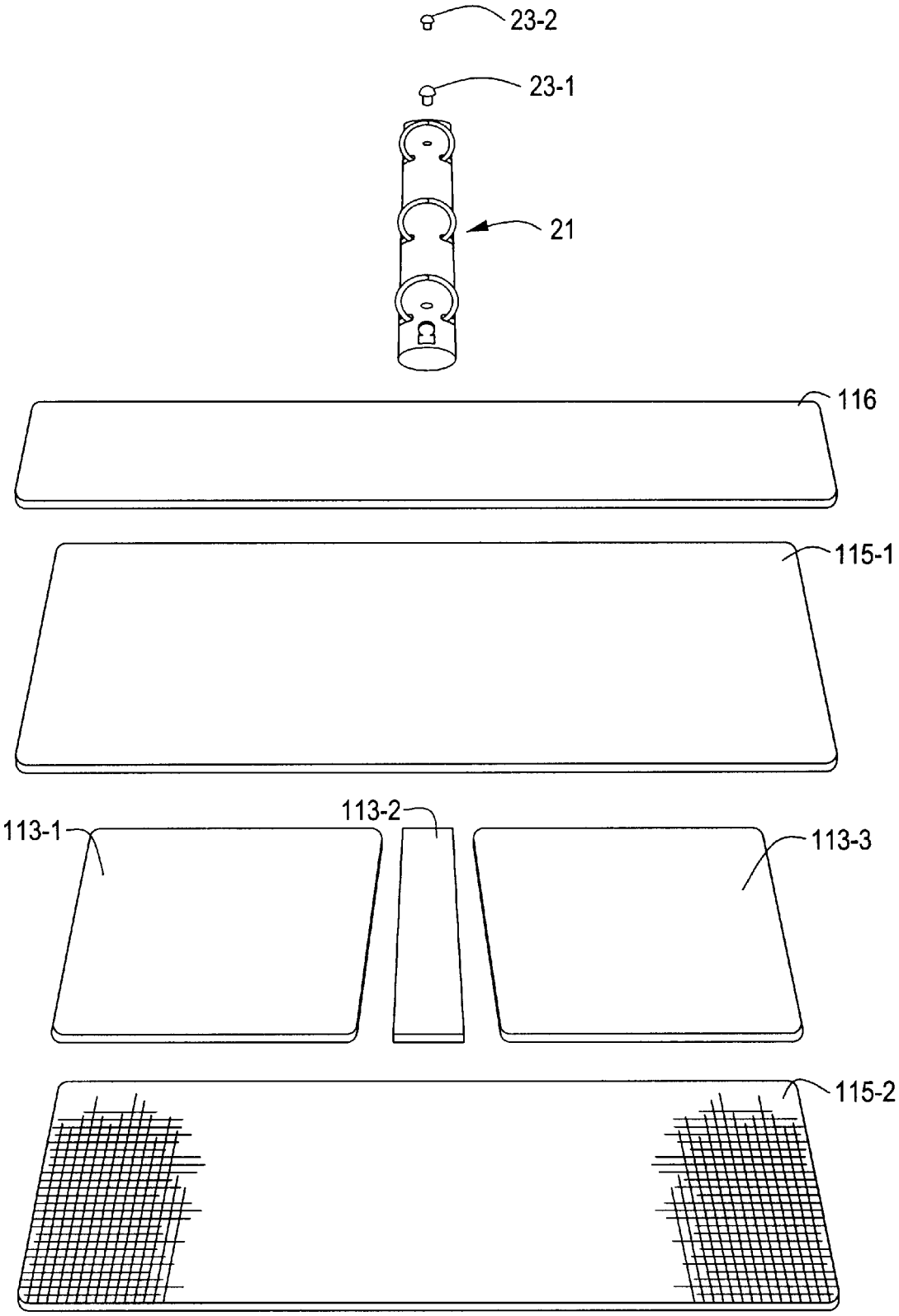
FIG. 6 is an exploded perspective view of the components of the paper storage item of FIG. 5, prior to assembly.

Referring to FIGS. 4 through 6, there are shown various views of a second embodiment of a paper storage item constructed according to the teachings of the present invention, the paper storage item being in the form of a ring binder represented generally by reference numeral 111. Perspective and top views of binder 111, fully assembled, are shown in FIGS. 4 and 5. An exploded perspective view of binder 111, prior to assembly, is shown in FIG. 6.

As seen best in FIG. 6, ring binder 111 comprises a plurality of stiffening members 113-1 through 113-3, which may be made of cardboard, chipboard, fiberboard or another similarly suitable material. As will hereinafter be seen, stiffening members 113-1 through 113-3 are appropriately arranged to help form the front cover, spine and rear cover, respectively, of binder 111.

Ring binder 111 also comprises inner and outer sheets 115-1 and 115-2, respectively, of comparable dimensions, which are disposed on opposite sides of stiffening members 113-1 through 113-3 so as to form respective inner and outer cover sheets thereto. Sheets 115-1 and 115-2 are both made of an ultrasonically-weldable synthetic material (which may be the same or different for both sheets); however, because sheet 115-1 is less prominent than sheet 115-2, especially when binder 111 is closed, sheet 115-1 is in the conventional form of a continuous film (made, for example, by extrusion), and sheet 115-2 is in the form of a woven sheet fabricated from a synthetic, ultrasonically-weldable fiber or thread. Materials that may be used to form said synthetic, ultrasonically-weldable fiber or thread include, but are not limited to, a wide range of plastics, such as vinyl, polypropylene, polyethylene, nylon, orlon, rayon and combinations thereof.

As seen best in FIGS. 4 and 5, sheets 115-1 and 115-2 are ultrasonically welded together around their respective peripheries to form a peripheral seam 117. (For simplicity and clarity, the individual fibers of sheet 115-2 are not shown throughout sheet 115-2.) In addition, sheets 115-1 and 115-2 are ultrasonically welded together along a pair of hinge lines 119-1 and 119-2 located on opposite sides of stiffening member 113-2, hinge lines 119-1 and 119-2 helping to demarcate the front cover 120-1, spine 120-2 and rear cover 120-3 (see FIG. 4) of binder 111 and to keep in place members 113-1 through 113-3.

Referring back to FIG. 6, binder 111 also comprises an elongated strip 116, strip 116 preferably being in the form of a continuous synthetic film weldable, preferably ultrasonically, to sheet 115-1. (Strip 116 could alternatively be in the form of a woven sheet.) In the embodiment shown, strip 116 has a length comparable to that of sheet 115-1 and a width considerably smaller (i.e., about ⅓ to about ½) than that of sheet 115-1. Strip 116 may be made of the same material as sheet 115-1 and/or sheet 115-2 or may be made of a different material than either of sheets 115-1 and 115-2. As seen best in FIG. 5, the bottom and side edges of strip 116 are welded to the corresponding bottom and side edges of sheet 115-1 along seam 117 so that strip 116 and sheet 115-2 together form a pocket suitable for holding papers and the like. As can readily be appreciated, strip 116 could alternatively be sized and welded appropriately to sheet 115-1 to form a sleeve suitable for holding a writing instrument or the like. Alternatively, multiple strips of material could be welded to different portions of sheet 115-1 to form both pockets and sleeves.

Ring binder 111 further comprises a conventional paper-retaining ring mechanism 121. In the embodiment shown, mechanism 121 is secured to the inside of spine 120-2 by a pair of rivets 123-1 and 123-2; however, it is to be understood that, instead of being secured to the inside of spine 120-2, mechanism 121 could alternatively be secured to the inside of front cover 120-1 or to the inside of rear cover 120-3.

To fabricate binder 111 according to one method, one appropriately positions stiffening members 113-1 through 113-3 between sheets 115-1 and 115-2 and appropriately positions strip 116 on top of sheet 115-1. Next, one ultrasonically welds together sheets 115-1 and 115-2 around their respective peripheries and on opposite sides of member 113-2 and, at the same time, ultrasonically welds together strip 116 and sheet 115-1 along their respective bottom and side edges. Finally, one secures ring mechanism 121 to spine 120-2 with rivets 123-1 and 123-2. As can readily be appreciated, some or all of the steps in the fabrication of binder 111 can be automated.

It is to be understood that sheets 115-1 and 115-2 and strip 116 may be rf welded together or thermally welded together, instead of being ultrasonically welded together, if sheets 115-1 and 115-2 and strip 116 are fabricated from a material that permits such welding techniques.

It is also to be understood that the principles of the present invention can be applied to other types of loose leaf binders, besides ring binders, and to paper storage items other than loose leaf binders, such as portfolios, pad holders, book covers, mailbags and the like.

The embodiments of the present invention recited herein are intended to be merely exemplary and those skilled in the art will be able to make numerous variations and modifications to it without departing from the spirit of the present invention. For example, the stiffening members of binders 11 and 111 could be replaced with a unitary stiffening member of the type disclosed in U.S. Pat. No. 5,620,207 (with sheets 15-1 and 15-2 or 115-1 and 115-2 being welded together only around their respective peripheries). Similarly, one or more of the stiffening members could be eliminated entirely (depending upon the rigidity of the woven synthetic sheets). In addition, the matching pair of woven synthetic sheets 15-1 and 15-2 of binder 11 could be replaced with a single woven synthetic sheet which has been folded over and then welded to itself. All such variations and modifications are intended to be within the scope of the present invention as defined by the claims appended hereto.

What is claimed is:

1. A ring binder comprising:

(a) at least one stiffener arranged as a front cover stiffening panel, a spine stiffening panel and a rear cover stiffening panel;

(b) a matching pair of woven synthetic sheets, said matching pair of woven synthetic sheets being disposed on opposite sides of said at least one stiffener and being welded together around their respective peripheries, whereby said at least one stiffener and said matching pair of woven synthetic sheets cooperatively define a binder cover having front and rear covers interconnected by a spine; and (c) a ring mechanism secured to one of said front cover, said spine and said rear cover of said binder cover.

2. The ring binder as claimed in claim 1 wherein said ring mechanism is secured to said spine.

3. The ring binder as claimed in claim 1 wherein said at least one stiffener comprises three discrete stiffening members constituting said front cover stiffening panel, said spine stiffening panel and said rear cover stiffening panel, respectively.

4. The ring binder as claimed in claim 3 wherein said woven synthetic sheets are additionally welded together on opposite sides of said spin stiffening panel.

5. The ring binder as claimed in claim 1 wherein each of said woven synthetic sheets comprises an ultrasonic weldable synthetic fiber and wherein said woven synthetic sheets are welded together ultrasonically around their respective peripheries.

6. The ring binder as claimed in claim 4 and wherein each of said woven synthetic sheets comprises an ultrasonically weldable synthetic fiber and wherein said woven synthetic sheets are welded together ultrasonically around their respective peripheries and on opposite sides of said spine stiffening panel.

7. The ring binder as claimed in claim 6 wherein said ultrasonically weldable synthetic fiber is made of a plastic.

8. The ring binder as claimed in claim 7 wherein said ultrasonically weldable synthetic fiber is made of at least one of the materials selected from the group consisting of polyvinyl chloride, polypropylene, polyethylene, nylon, orlon and rayon.

9. The ring binder as claimed in claim 1 wherein each of said woven synthetic sheets comprises an ultrasonically weldable plastic fiber.

10. A method of making a ring binder, said method comprising the steps of:

(a) providing one or more stiffeners defining a front cover stiffening panel, a spine stiffening panel and a rear cover stiffening panel;

(b) positioning a matching pair of woven synthetic sheets on opposite sides of said one or more stiffeners, each of said woven synthetic sheets being made of an ultrasonically weldable plastic fiber;

(c) ultrasonically welding together said matching pair of woven synthetic sheets around their respective peripheries, whereby said one or more stiffeners and said matching pair of woven synthetic sheets cooperatively define a binder cover having front and rear covers interconnected by a spine; and (d) securing a ring mechanism to one of said front cover, said spine and said rear cover of said binder cover.

11. The method as claimed in claim 10 wherein said one or more stiffeners comprise three discrete stiffening members constituting said front cover stiffening panel, said spine stiffening panel and said rear cover stiffening panel, respectively, said method further comprising the step of ultrasonically welding together said matching pair of woven synthetic sheets on opposite sides of said spine stiffening panel.

12. The method as claimed in claim 11 wherein said ultrasonically weldable plastic fiber is made of at least one of the materials selected from the group consisting of polyvinyl chloride, polypropylene, polyethylene, nylon, orlon and rayon.

13. A binder cover comprising:

(a) a front cover stiffening member;

(b) a rear cover stiffening member spaced apart from and oriented parallel to said front cover stiffening member; and (c) inner and outer synthetic sheets, said inner and outer synthetic sheets being disposed on opposite sides of said front and rear cover stiffening members and being welded together around their respective peripheries, at least one of said inner and outer synthetic sheets being a woven synthetic sheet, wherein said outer synthetic sheet is a woven synthetic sheet and wherein said inner synthetic sheet is a continuous film.

* * * * *